US008265493B2

(12) United States Patent
Amann et al.

(10) Patent No.: US 8,265,493 B2
(45) Date of Patent: Sep. 11, 2012

(54) OPTICAL SENSOR ARRANGEMENT FOR AN IMAGING APPARATUS

(75) Inventors: Mark William Amann, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 266 days.

(21) Appl. No.: 12/790,278

(22) Filed: May 28, 2010

(65) Prior Publication Data

US 2011/0293296 A1 Dec. 1, 2011

(51) Int. Cl.
*G03G 15/08* (2006.01)

(52) U.S. Cl. ..... 399/27; 399/29; 399/61; 399/64

(58) Field of Classification Search ..... 399/24, 399/25, 27–30, 58, 61–64, 110, 111, 119, 399/120, 252, 262, 263; 222/DIG. 1
See application file for complete search history.

(56) References Cited

U.S. PATENT DOCUMENTS

| | | | | |
|---|---|---|---|---|
| 7,260,342 | B2 * | 8/2007 | Nishimura | 399/113 |
| 7,970,297 | B2 * | 6/2011 | Inoue et al. | 399/35 |
| 2002/0021421 | A1 * | 2/2002 | Inomata | 355/27 |

* cited by examiner

*Primary Examiner* — Hoan Tran
(74) *Attorney, Agent, or Firm* — Justin M Tromp; John Victor Pezdek

(57) ABSTRACT

An imaging apparatus includes a toner cartridge within a housing having a rotatable shaft, a cam rotatably mounted on the shaft, an optical sensor mounted on the housing having an emitter and a receiver forming an optical path therebetween, and a flag mounted on the housing having a first arm and a second arm. The optical sensor has an output that changes when the optical path changes from blocked to unblocked and from unblocked to blocked. The flag has a home position where the first arm is disposed in the rotational path of the cam and the second arm either blocks the optical path or unblocks the optical path. Rotation of the rotatable shaft causes the cam to engage and disengage the first arm causing the second arm to change from blocking the optical path to unblocking the optical path or vice versa.

20 Claims, 9 Drawing Sheets

OPTICAL SENSOR ARRANGEMENT FOR AN IMAGING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to an imaging apparatus and particularly to an imaging apparatus having an optical sensor arrangement for determining the amount of toner remaining in a toner cartridge.

2. Description of the Related Art

An imaging apparatus such as a copier, printer, facsimile machine, multifunction device, or the like may include a toner cartridge that is removably mounted within the image forming apparatus having a toner reservoir therein. The toner reservoir may include two separate sections for containing toner, a large upper section that stores the majority of the toner when not in use and a small lower section that contains just enough toner to be used during printing. A mechanism in the toner cartridge signals for the upper section to deliver a fixed amount of toner to the lower section when the supply in the lower section gets low. The number of deliveries of toner to the lower section, i.e., the number of "toner addition cycles" or TAC's, may be counted and tracked.

The toner cartridge may include a "gas gage" to indicate to a user an estimate of the amount of toner remaining in the toner cartridge. The number of TAC's may form the basis for the estimate provided by the gas gage. If the initial toner supply, the amount of toner transferred per TAC and the number of TAC's to date are known, the amount of toner remaining in the upper section of the toner reservoir can be estimated.

One prior art system for tracking the number of TAC's includes a cam attached to the shaft of a paddle in the large upper section of the toner reservoir. A pogo pin included in the image forming apparatus rides on the cam and is biased toward the shaft of the paddle with a spring that connects to a push-button sensor. The pogo pin is in constant contact with the cam. When the cam rotates, the pogo pin is pushed back causing the spring to compress and activate the push-button sensor. The number of sensor activations is then used to determine the number of TAC's.

A problem with this system is that it imparts a force continuously on the cartridge regardless of whether the paddle is rotating. This force varies greatly both in magnitude and direction depending on whether the spring is compressed. This relatively large and widely varying force on the toner cartridge may result in print defects. Accordingly, it will be appreciated that a sensor arrangement is needed to track the number of TAC's and, in particular, a sensor arrangement that imparts a relatively low amount of force on the toner cartridge is desired and, if possible, applying only intermittent force.

SUMMARY OF THE INVENTION

According to an exemplary embodiment, an imaging apparatus includes a housing and a toner cartridge therein. The toner cartridge includes a toner reservoir therein. The toner reservoir has an upper sump area for containing toner and a lower sump area for containing toner. A metering bar is rotatably positioned between the upper sump area and the lower sump area. The metering bar has a shaft and at least one depression therein for holding toner. Rotation of the metering bar transfers toner from the upper sump area to the lower sump area. A paddle for moving toner toward the metering bar is rotatably disposed in the upper sump area. The paddle has a shaft. A cam is rotatably mounted outside the toner cartridge on either the shaft of the paddle or the shaft of the metering bar. An optical sensor is mounted on the housing having an emitter and a receiver. The emitter and the receiver form an optical path therebetween. The optical sensor has an output that changes when the optical path changes from blocked to unblocked and from unblocked to blocked. A flag is mounted on the housing having a first arm and a second arm. The flag has a home position where the first arm is disposed in the rotational path of the cam and the second arm either blocks the optical path or unblocks the optical path. Rotation of the rotatable shaft causes the cam to engage and disengage the first arm causing the second arm to change from blocking the optical path to unblocking the optical path or vice versa.

Some embodiments include a blocking member transversely mounted on the second arm for blocking at least a portion of the light emitted by the emitter when the flag is in the home position and as the flag moves to and from the home position. The blocking member is aligned between the optical path and a photoconductive drum disposed in the cartridge for blocking at least a portion of the light emitted by the emitter from the photoconductive drum.

Embodiments include those wherein the imaging apparatus includes a means for biasing the flag toward the home position when the cam is not engaged with the flag. In some embodiments, the biasing means is a spring. Embodiments include those wherein the flag is a bell crank that has a pivot point between the first arm and the second arm. The engagement of the cam with the flag causes the flag to pivot about the pivot point away from the home position.

In some embodiments, the optical sensor has a pair of opposed arms. The emitter and the receiver are each mounted in a respective one of the pair of opposed arms forming the optical path between the pair of opposed arms. Each of the pair of opposed arms has a distal portion adjacent to the toner cartridge. In some embodiments, the blocking member contacts the distal portion of each of the pair of opposed arms when the flag is in the home position. Embodiments include those wherein the emitter emits light continuously when the imaging apparatus is turned on.

BRIEF DESCRIPTION OF THE DRAWINGS

The above-mentioned and other features and advantages of the various embodiments of the invention, and the manner of attaining them, will become more apparent and the invention will be better understood by reference to the following description of embodiments of the invention taken in conjunction with the accompanying drawings, wherein.

DETAILED DESCRIPTION

Figure 1:
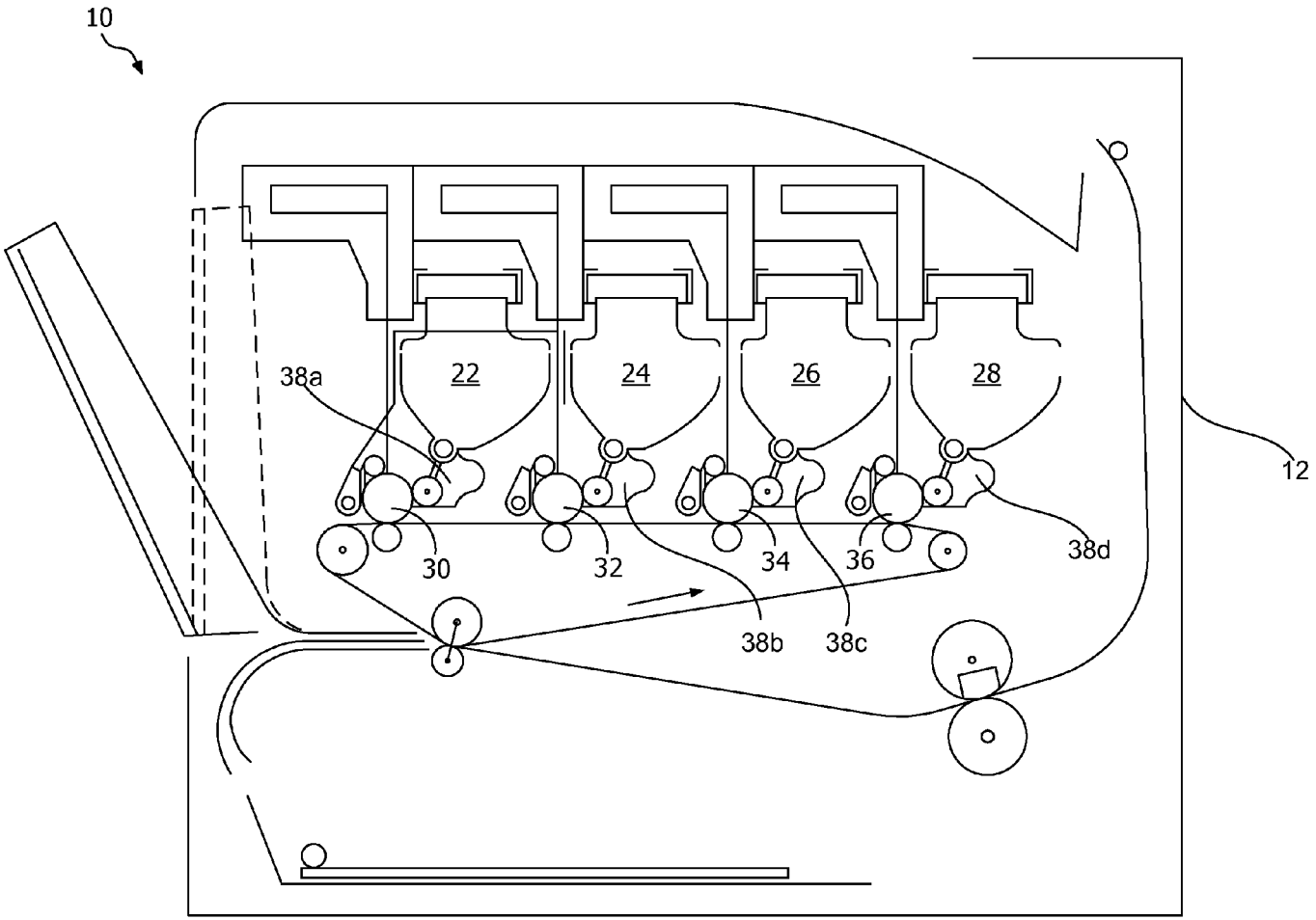
FIG. 1 is a schematic view of one embodiment of an imaging apparatus according to the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention may include both hardware and electronic components or modules that, for purposes of discussion, may be illustrated and described as if the majority of the components were implemented solely in hardware. Reference will now be made in detail to the exemplary embodiment(s) of the present invention, as illustrated in the accompanying drawings. Whenever possible, the same reference numerals will be used throughout the drawings to refer to the same or like parts.

With reference to FIG. 1, one embodiment of an imaging apparatus 10 is shown. The imaging apparatus 10 includes a housing 12 and a plurality of toner cartridges 22, 24, 26, and 28 removably contained therein. Each of the toner cartridges 22, 24, 26, and 28 is of similar construction but is distinguished by the toner color contained therein. Each toner color forms an individual image of a single color that is combined in layered fashion to create the final multi-colored image. Each of the toner cartridges 22, 24, 26, and 28 is substantially identical and includes photoconductor 30, 32, 34, and 36 respectively. Each of the toner cartridges 22, 24, 26, and 28 can be removed and replaced within the image forming apparatus 10. Replacement is typically necessary when no workable toner remains within the toner cartridge 22, 24, 26, and 28. Each toner cartridge 22, 24, 26 and 28 includes a toner reservoir 38*a*, 38*b*, 38*c* and 38*d*. Alternative embodiments include those wherein the imaging apparatus 10 includes one toner cartridge structured to contain black toner for a black only imaging apparatus.

Figure 2:
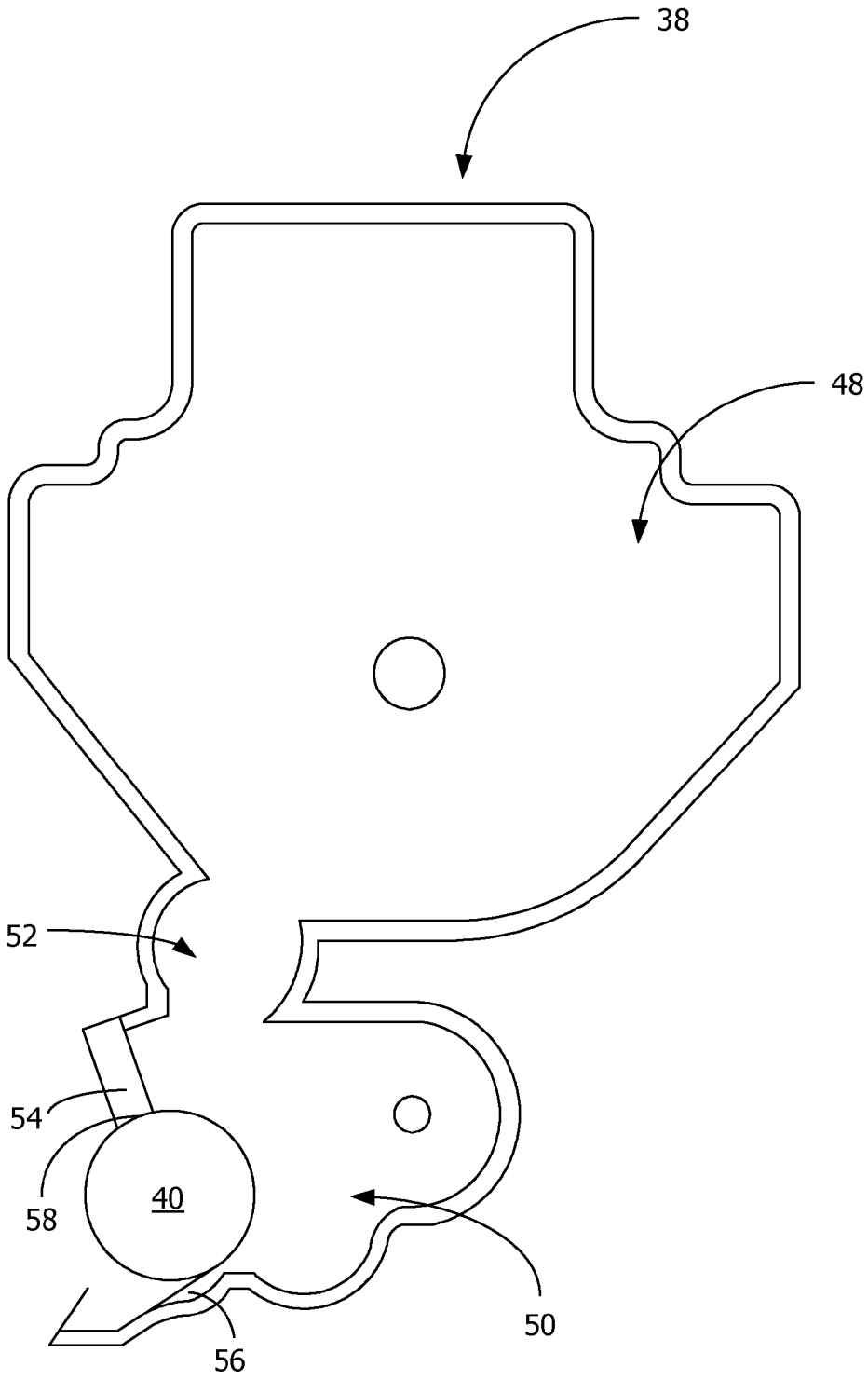
FIG. 2 is a cross-sectional view of one embodiment of a toner reservoir according to the present invention.

With reference to FIG. 2, a toner reservoir 38 is shown. Toner is contained within the toner reservoir 38. The toner reservoir 38 includes an upper sump area 48 for containing toner and a lower sump area 50 for containing toner. A developer roller 40 is positioned adjacent to the lower sump area 50. The developer roller 40 transfers toner to the photoconductors 30, 32, 34, and 36 (FIG. 1). A doctor blade 54 is positioned in contact with the developer roller 40 for controlling the amount of toner attracted to the photoconductors 30, 32, 34, and 36. The doctor blade 54 preferably forms an outer edge of the lower sump area 50 as shown in FIG. 2; however, the doctor blade 54 may be contained within the walls of the lower sump area 50. A seal 56 extends from the edge of the lower sump area 50 to the developer roller 40 to prevent toner leakage.

In the exemplary embodiment shown, the upper sump area 48 holds a larger amount of toner than the lower sump area 50. This provides for a larger overall volume of toner reservoir 38 without placing pressure on a doctor blade nip 58 formed between the doctor blade 54 and developer roller 40. If too much toner is positioned against the doctor blade 54, inconsistent amounts of toner may be transferred from the developer roller 40 to the photoconductors 30, 32, 34, and 36 resulting in poor print quality and/or print errors. Isolating the lower sump area 50 from the larger amount of toner contained in the upper sump area 48 controls the amount of pressure on the opening between the doctor blade 54 and developer roller 40 and reduces or eliminates print errors caused by excessive toner passing between the doctor blade 54 and developer roller 40. The upper sump area 48 may be positioned vertically above the lower sump area 50. This allows gravity to assist in moving the toner from the upper sump area 48 to the lower sump area 50.

Figure 3:
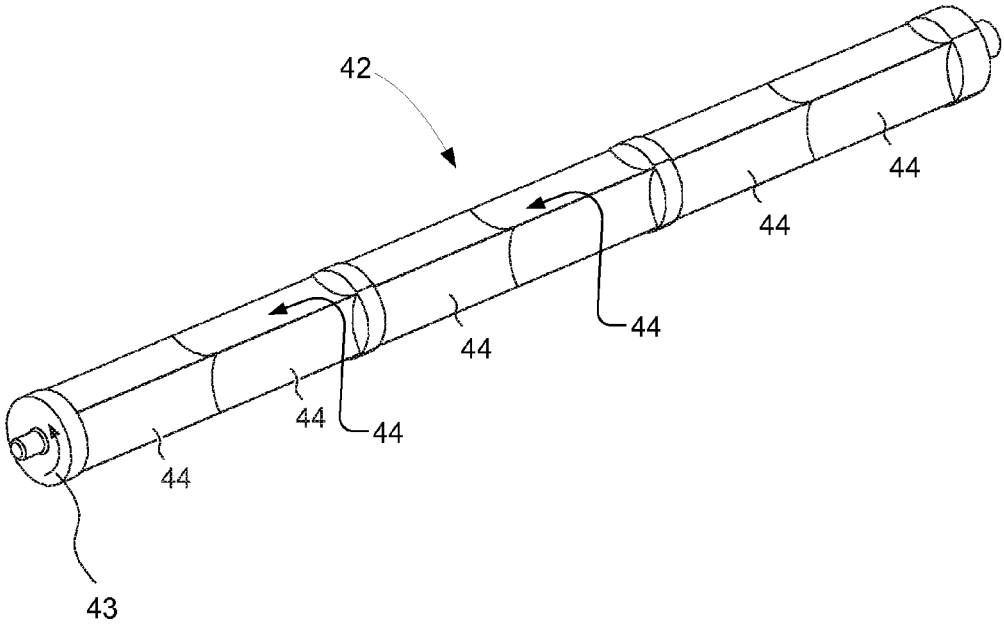
FIG. 3 is a perspective view of one embodiment of a metering bar according to the present invention.

Embodiments include those wherein the toner is supplied from the upper sump area 48 to the lower sump area 50 using a geared toner supply mechanism having any suitable structure as would occur to the skilled artisan practicing the invention. An intermediate area 52 is positioned between the upper sump area 48 and the lower sump area 50 and provides a path for toner to move from the upper sump area 48 to the lower sump area 50. With reference to FIG. 3, a metering bar is shown. The metering bar 42 is rotatably positioned in the intermediate area 52 between the upper sump area 48 and the lower sump area 50. The metering bar 42 is generally cylindrical in shape and extends along the length of toner reservoir 38. The metering bar 42 includes a rotatable shaft 43 and at least one depression 44 therein for holding toner. The exemplary embodiment shown includes a plurality of axially and circumferentially spaced depressions 44. Selection of the number of depressions 44 and the curvature of such depressions may be made by one skilled in the art practicing the invention, the specific selection not considered limiting of the invention or of the appended claims.

Rotation of the metering bar 42 transfers toner from the upper sump area 48 to the lower sump area 50. When the toner in the lower sump area 50 gets low, the metering bar 42 delivers toner from the upper sump area 48 to the lower sump area 50 in a toner addition cycle (TAC). During a TAC, the metering bar 42 rotates a predetermined amount in order to deliver a fixed amount of toner from the upper sump area 48 to the lower sump area 50. Upon rotation of metering bar 42, each depression 44 is positioned alternately at a first position open to upper sump area 48 where it is filled with toner with rotation of paddle 66 (FIG. 4) assisting in the movement of toner into depressions 44 and at a second position open to lower sump area 50 where the toner is removed from depressions 44.

As would also occur to a skilled artisan, the toner cartridge 22, 24, 26 and 28 may include one housing or may be split into two housings detachably mounted together, each containing a sump area. Further, metering bar 42 and lower sump area 50 may be structured as elements of the imaging apparatus 10 itself, as opposed to elements of the toner cartridge 22, 24, 26 and 28. In this arrangement, toner reservoir 38 may be insertable into imaging apparatus 10 as a separate unit and operatively engage metering bar 42 in a substantially similar manner to that depicted in the accompanying drawing figures.

Figure 4:
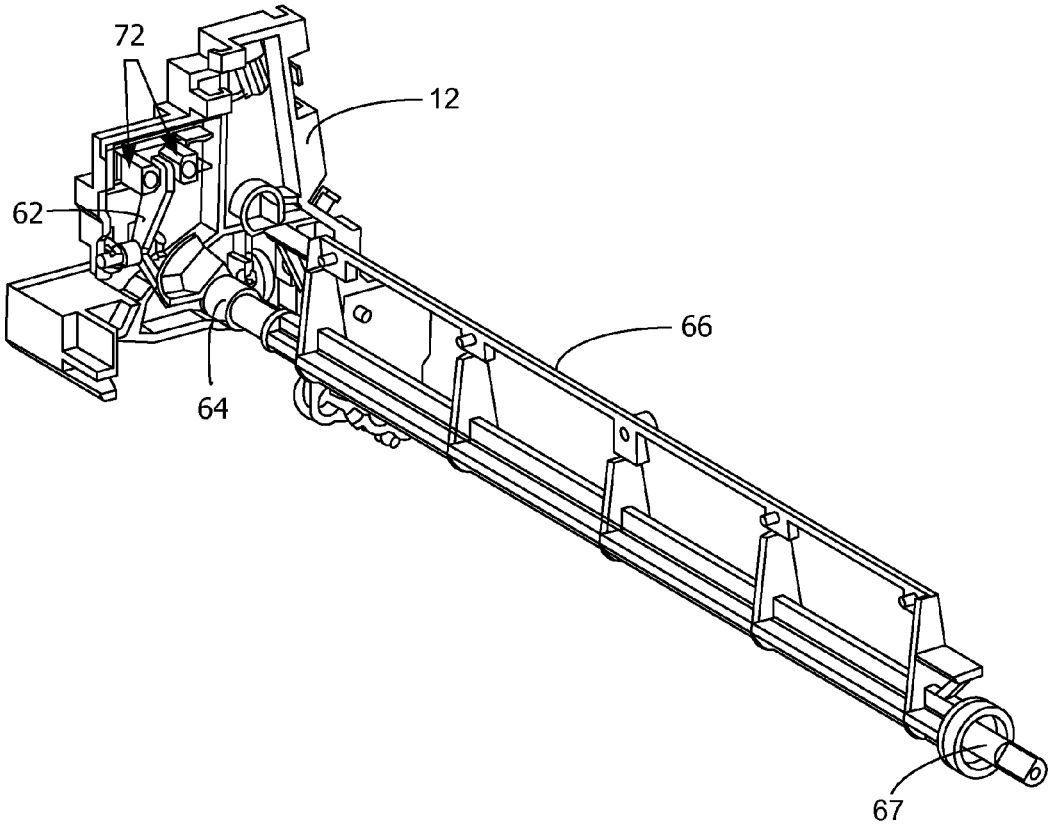
FIG. 4 is a perspective view of one embodiment of an optical sensor arrangement according to the present invention.
Figure 5:
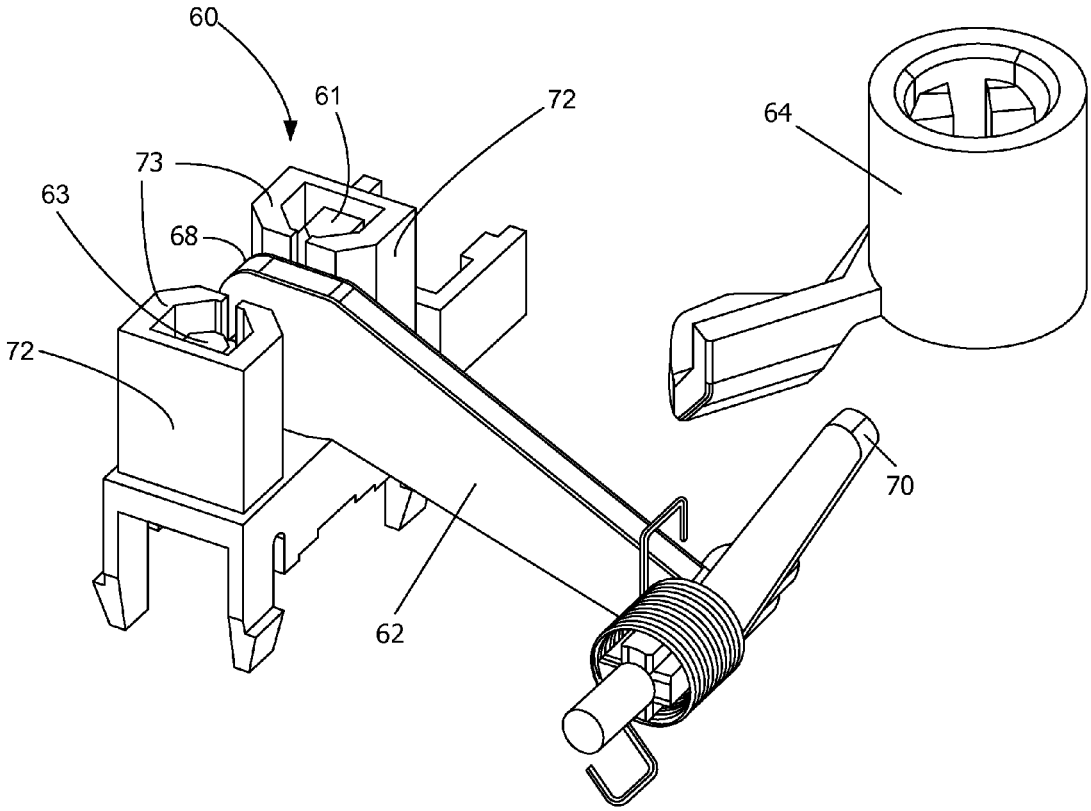
FIG. 5 is an isometric view of the optical sensor arrangement of FIG. 4 with a flag, an optical sensor and a cam showing the flag in a home position.

With reference to FIG. 4, a paddle 66 for moving toner toward the metering bar 42 is shown. The paddle 66 is rotatably positioned in the upper sump area 48 and includes a rotatable shaft 67. The paddle 66 agitates toner in the upper sump area 48 to facilitate transfer of toner to lower sump area 50. Each time a TAC occurs, the paddle 66 rotates to fill the depressions 44 of the metering bar 42 with toner. Paddle 66 may be sized to extend substantially the length of toner reservoir 38 and to rotate closely to the walls of toner reservoir 38 so as to agitate and prevent clumping of toner. Paddle 66 may otherwise be configured for the intended purpose as would occur to the skilled artisan. One or more drive mechanisms (not shown) are in operative engagement with paddle 66 and metering bar 42 to facilitate rotation of paddle 66 and metering bar 42 as is known in the art.

In the exemplary embodiment shown in FIG. 4, a cam 64 is rotatably mounted outside the toner cartridge 22, 24, 26 and 28 on the rotatable shaft 67 of the paddle 66. Alternatives include those wherein the cam 64 is mounted on the rotatable shaft 43 of the metering bar 42. In some embodiments, the cam 64 is mounted to the rotatable shaft 67 or the rotatable shaft 43 with a collar portion 64*a* that fits over the shaft the cam 64 is mounted to.

With reference to FIGS. 5-8, an optical sensor 60 is mounted on housing 12. The optical sensor 60 includes an emitter 61 and a receiver 63. The emitter 61 and receiver 63 form an optical path therebetween. The optical sensor 60 has an output that changes when the optical path changes from blocked to unblocked or from unblocked to blocked. In the exemplary embodiment shown, the emitter 61 and the receiver 63 are housed in a pair of opposed arms 72 such that the optical path is formed between the pair of opposed arms 72. In some embodiments, the emitter 61 resides on a first of the opposed arms 72 and the receiver 63 resides on a second of the opposed arms 72. Alternatives include those wherein both the emitter 61 and the receiver 63 reside on the first of the opposed arms 72 and a reflecting surface resides on the second of the opposed arms 72 thereby allowing the optical path to be positioned between the pair of opposed arms 72. In the exemplary embodiment shown, the pair of opposed arms 72 is used to form the optical path; however, one skilled in the art will appreciate that any suitable arrangement may be used. Embodiments include those wherein the emitter 61 emits light continuously when the light is turned on. Alternatives include those wherein the emitter 61 emits light only during operation.

As shown in FIG. 4, a flag 62 is mounted on the housing 12 of the imaging apparatus 10. With reference back to FIGS. 5-8, the flag 62 includes arms 68 and 70. The flag has a home position illustrated in FIGS. 5 and 6 wherein arm 70 is disposed within the rotational path of cam 64 and arm 68 is disposed blocking the optical path of optical sensor 60. The home position may be reversed such that arm 68 is disposed so that it does not block the optical path of optical sensor 60. In some embodiments, flag 62 is a bell crank having a pivot point about which the bell crank pivots. However, one skilled in the art will recognize that the flag may be any suitable shape.

Figure 6:
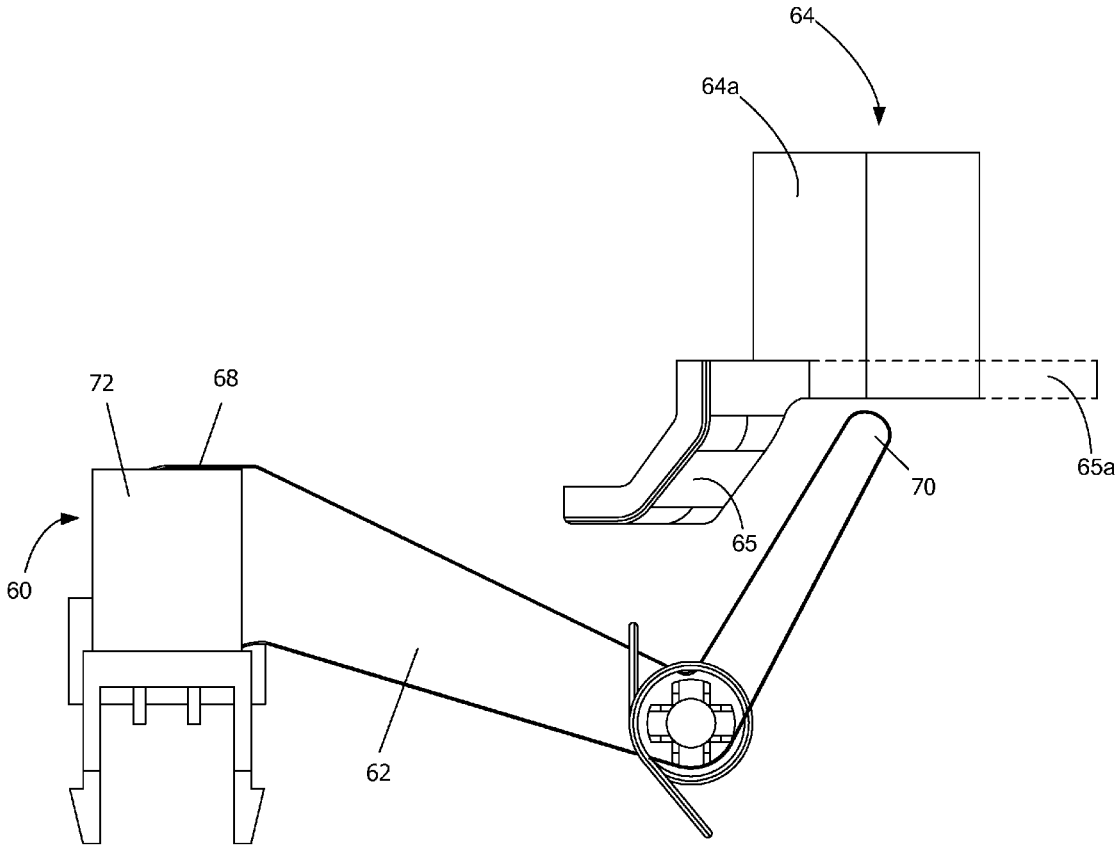
FIG. 6 is a side elevation view of the optical sensor arrangement of FIG. 5.
Figure 7:
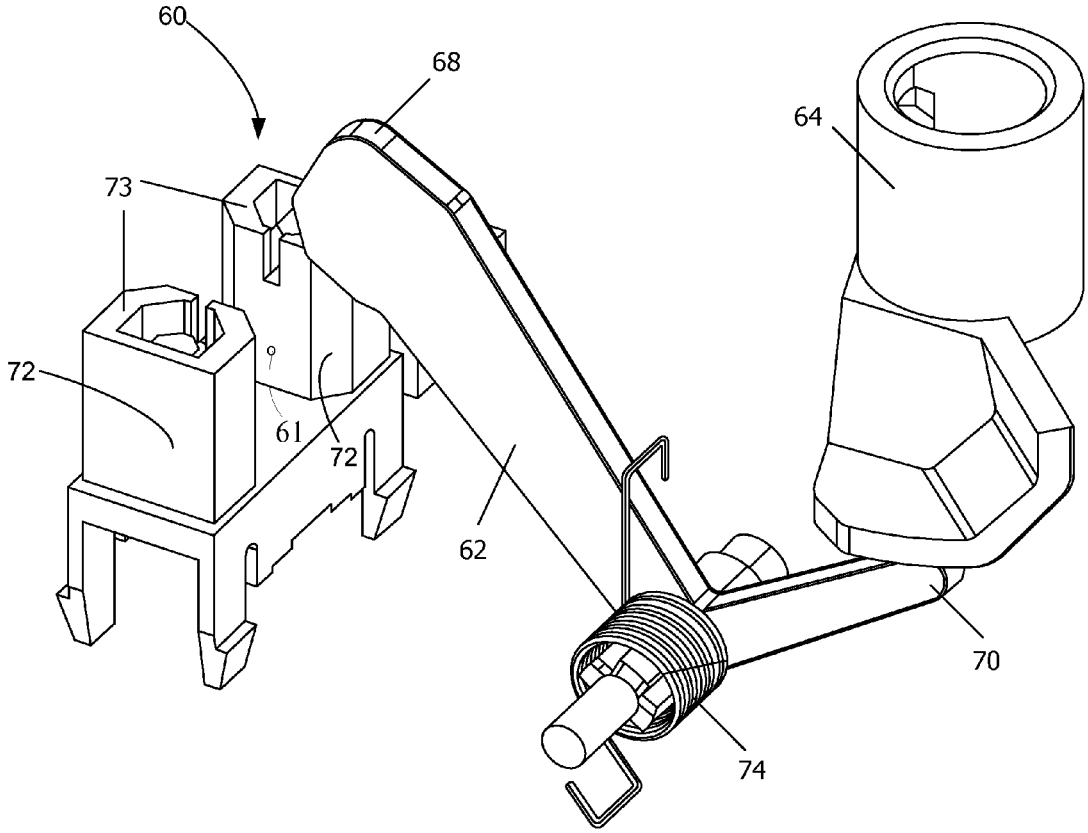
FIG. 7 is an isometric view of the optical sensor arrangement of FIG. 4 with a flag, an optical sensor and a cam showing the flag displaced from the home position by the cam.
Figure 8:
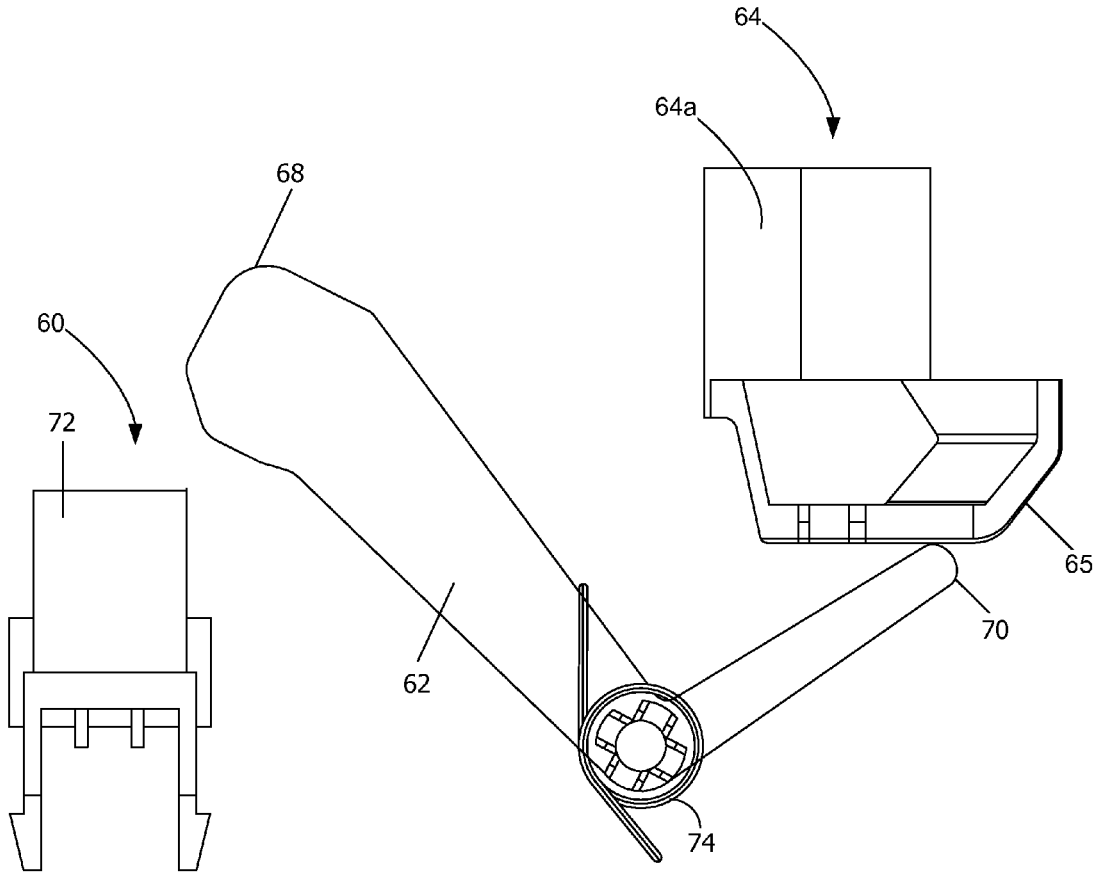
FIG. 8 is a side elevation view of the optical sensor arrangement of FIG. 7.

As shown in FIGS. 7 and 8, rotation of the shaft 67 causes the cam 64 to engage and disengage the arm 70 causing the arm 68 to change from blocking the optical path (a home position) formed by the optical sensor 60 to unblocking the optical path and back to blocking the optical path. As shown in FIGS. 6 and 8, the contact surface 65 of the cam 64 engages the flag 62 intermittently. As a result, the force applied by the flag 62 and biasing means 74 to the cam 64 and the rotatable shaft that the cam 64 is mounted to is intermittent. The contact surface 65 of the cam 64 of the embodiment illustrated in FIG. 8 does not surround the entire circumference of the collar portion 64*a*. The dashed lines in FIG. 6 show an alternative embodiment where a flange 65*a* extends around the entire circumference of the collar portion 64*a*. However, the cam 64 is positioned such that only a portion of the flange 65*a*, the contact surface 65, engages with the flag 62, thereby permitting intermittent engagement between the cam 64 and the flag 62. The flag 62 includes biasing means 74 for biasing the flag 62 toward the home position when the cam 64 is not engaged with the flag 62. In the exemplary embodiment shown, biasing means 74 includes a spring; however, any suitable means for biasing the flag 62 toward the home position may be used.

When a toner addition cycle occurs, cam 64 rotates and engages arm 70 of the flag 62. The force applied to arm 70 by the rotation of cam 64 causes arm 68 to move out of the optical path of the optical sensor 60 at which point the optical sensor 60 signals a processor (not shown) connected to the optical sensor 60 that a toner addition cycle has occurred. The cam 64 then rotates further and disengages from arm 70 allowing biasing means 74 to return arm 68 to a position blocking the optical path of optical sensor 60 changing the state of the signal sent to the processor. The optical sensor 60 output changes when the optical path changes from blocked to unblocked and from unblocked to blocked. The processor counts the number of times the output signal from the optical sensor 60 is changes state in order to determine the number of toner addition cycles. The processor is then able to use the number of toner addition cycles in combination with the initial supply of toner in toner cartridge 22, 24, 26 and 28 and the amount of toner transferred per toner addition cycle to calculate an estimate of the amount of toner remaining in toner cartridge 22, 24, 26 and 28. The imaging apparatus 10 may then display the estimated toner amount to a user in the form of a "gas gage."

The force imparted on the cam 64 by the flag 62 is generally smaller than the force imparted by the biasing means 74 on the flag to restore the flag to the home position due to the mechanical advantage provided by the cam 64 and flag 62 arrangement. As a result, the force imparted on the rotatable shaft that the cam 64 is mounted on is relatively small and less than prior art pogo pin and push sensor assemblies. This low force reduces the overall variation in force on the toner cartridge 22, 24, 26 and 28 which in turn reduces the probability of print defects. Unlike the prior art pogo pin/sensor switch assembly having continuous contact between the pogo pin and cam during the entire rotation of the cam, with the present assembly, the force applied to the cartridge is intermittent due to the limited engagement between the cam 64 and the arm 70 during only a portion of the rotation of cam 64, thus the force is smaller and applied for a shorter duration than in the prior art assembly. Further, the use of optical sensing, as opposed to mechanical sensing, reduces the force on the toner cartridge 22, 24, 26 and 28. Testing has shown that the force required to displace flag 62 in the exemplary embodiment depicted in FIG. 4 varies between 8 and 12 grams-force. In this embodiment, testing has shown that the torsion of biasing means 74 where a spring is utilized is approximately 0.6 N*mm.

Figure 9:
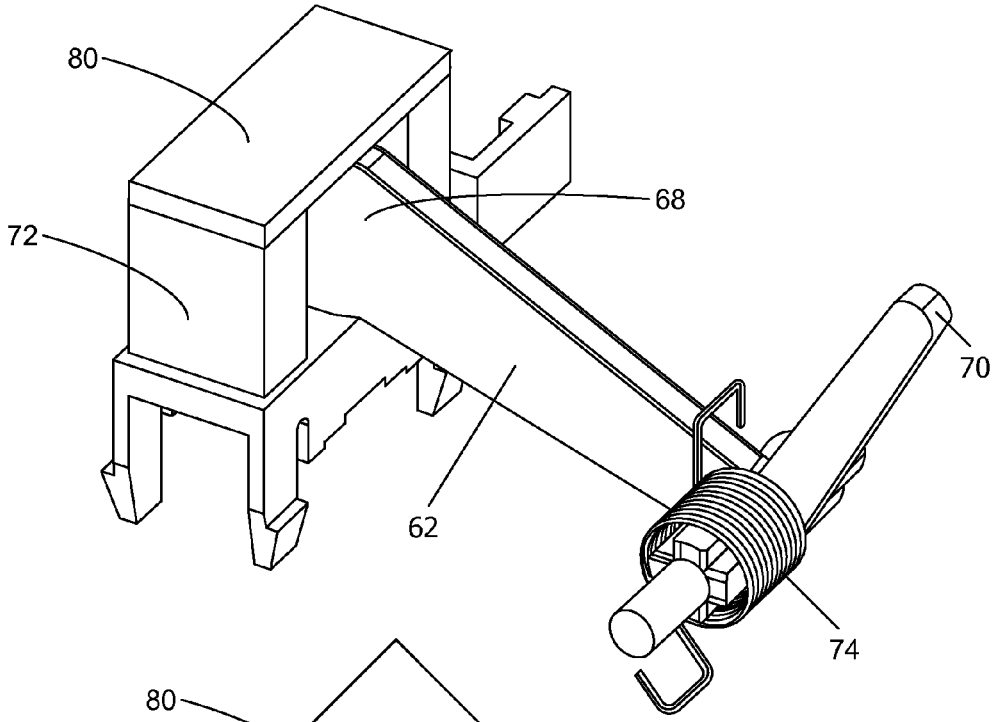
FIG. 9 is an isometric view of an alternative embodiment of the optical sensor arrangement showing a blocking member disposed on the flag.
Figure 10:
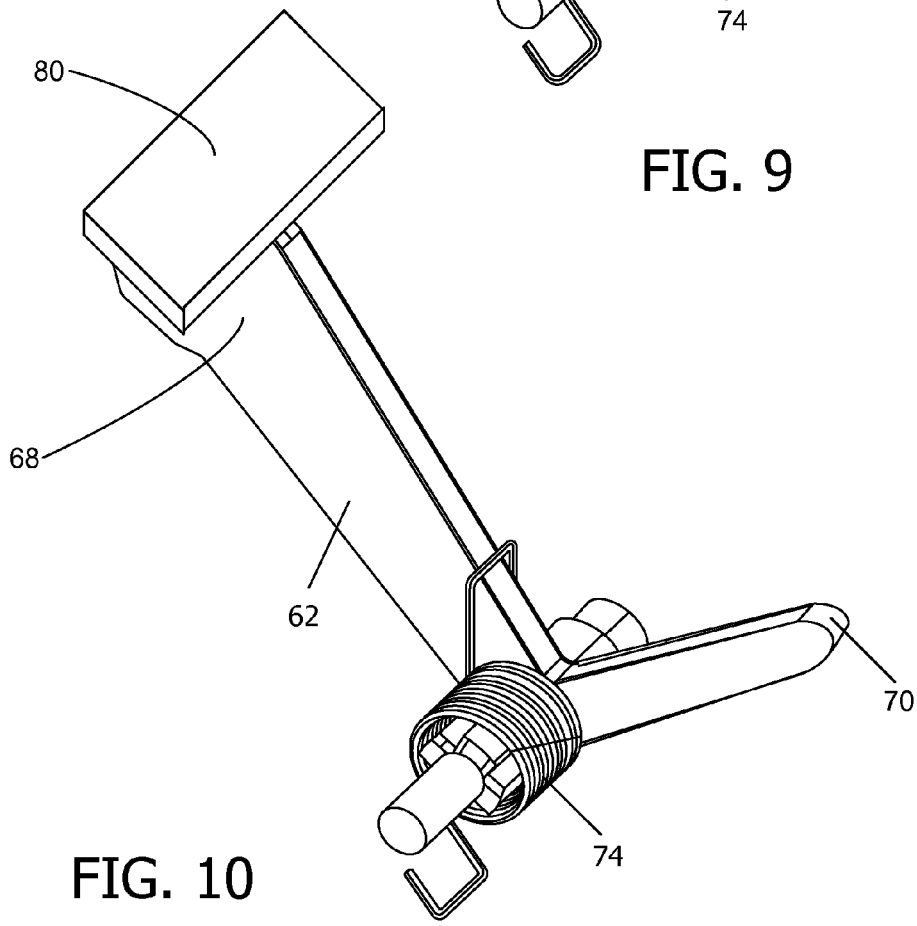
FIG. 10 is an isometric view of the flag of FIG. 9.

With reference to FIGS. 9 and 10, a blocking member 80 is transversely mounted on the arm 68 for blocking at least a portion of the light emitted by optical sensor 60 when the flag 62 is in the home position and as the flag 62 moves to and from the home position. Continued exposure to light may inhibit the ability of the photoconductor 30, 32, 34 and 36 to properly form a latent image and accurately transfer toner to a media sheet. Accordingly, in some embodiments, the blocking member 80 is aligned between the optical path of the optical sensor 60 and the photoconductor 30, 32, 34 and 36 of toner cartridge 22, 24, 26 and 28. This allows the blocking member 80 to block at least a portion of the light emitted by the optical sensor 60 from contacting the photoconductor 30, 32, 34 and 36. The blocking member 80 also helps prevent toner that may be present in the housing 12 from contaminating the optical sensor 60. In some embodiments, the blocking member 80 contacts a distal portion 73 adjacent to the toner cartridge 22, 24, 26 and 28 of each of the pair of opposed arms 72 when the flag 62 is in the home position.

While the exemplary embodiments described herein discuss the cam 64 mounted on the rotatable shaft 43 of the metering bar 42 or on the rotatable shaft 67 of paddle 66, the arrangement of the cam 64, the flag 62 and the optical sensor 60 may be used in combination with any rotatable member where it is desired to count the number of rotations of the rotatable member.

The invention therefore provides an imaging apparatus including a toner cartridge within a housing having a rotatable shaft and a cam rotatably mounted on the shaft, an optical sensor mounted on the housing having an emitter and a receiver, the emitter and the receiver forming an optical path therebetween, the optical sensor having an output that changes when the optical path changes from blocked to unblocked and from unblocked to blocked, a flag mounted on the housing having a first arm and a second arm, the flag having a home position where the first arm is disposed in the rotational path of the cam and the second arm either blocks the optical path or unblocks the optical path, wherein rotation of the rotatable shaft causes the cam to engage and disengage the first arm causing the second arm to change from blocking the optical path to unblocking the optical path or vice versa.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is understood that the invention may be practiced in ways other than as specifically set forth herein without departing from the scope and essential characteristics of the invention. It is intended that the scope of the invention be defined by the claims appended hereto.

What is claimed is:

1. An imaging apparatus, comprising:

a housing;

a toner cartridge within the housing, the toner cartridge having a rotatable shaft;

a cam mounted outside the toner cartridge on the rotatable shaft;

an optical sensor mounted on the housing having an emitter and a receiver, the emitter and the receiver forming an optical path, the optical sensor having an output that changes when the optical path changes from blocked to unblocked and from unblocked to blocked; and a flag mounted on the housing having a first arm and a second arm, the flag having a home position where the first arm is disposed in the rotational path of the cam and the second arm is disposed in one of: blocking the optical path and unblocking the optical path;

wherein rotation of the rotatable shaft causes the cam to engage and disengage the first arm causing the second arm to change from one of blocking the optical path and unblocking the optical path.

2. The imaging apparatus of claim 1, further comprising a blocking member mounted on the second arm for blocking at least a portion of the light emitted by the emitter when the flag is in the home position and as the flag moves to and from the home position.

3. The imaging apparatus of claim 2, further comprising a photoconductive drum disposed in the cartridge, the blocking member being aligned between the optical path and the photoconductive drum for blocking at least a portion of the light emitted by the emitter from the photoconductive drum.

4. The imaging apparatus of claim 1, further comprising a toner reservoir within the toner cartridge and a paddle for moving toner rotatably disposed in the toner reservoir, the paddle mounted on the rotatable shaft.

5. The imaging apparatus of claim 1, further comprising:

a toner reservoir within the toner cartridge, the toner reservoir having an upper sump area for containing toner and a lower sump area for containing toner; and a metering bar for transferring toner from the upper sump area to the lower sump area rotatably positioned between the upper sump area and the lower sump area, the metering bar mounted on the rotatable shaft.

6. The imaging apparatus of claim 1, further comprising a means for biasing the flag toward the home position when the cam is not engaged with the flag.

7. The imaging apparatus of claim 6, further comprising the flag having a pivot point between the first arm and the second arm, the engagement of the cam with the flag causing the flag to pivot about the pivot point away from the home position.

8. The imaging apparatus of claim 7, wherein the flag is a bell crank.

9. The imaging apparatus of claim 1, further comprising the optical sensor having a pair of opposed arms, the emitter and the receiver each mounted in a respective one of the pair of opposed arms and forming the optical path between the pair of opposed arms.

10. The imaging apparatus of claim 1, wherein the emitter emits light continuously when the imaging apparatus is turned on.

11. An imaging apparatus comprising:

a housing;

a toner cartridge having a toner reservoir therein, the toner reservoir having an upper sump area for containing toner and a lower sump area for containing toner;

a metering bar rotatably positioned between the upper sump area and the lower sump area, the metering bar having a shaft and at least one depression therein for holding toner, wherein rotation of the metering bar transfers toner from the upper sump area to the lower sump area;

a paddle for moving toner toward the metering bar rotatably disposed in the upper sump area, the paddle having a shaft;

a cam mounted outside the toner cartridge on one of the shaft of the paddle and the shaft of the metering bar;

an optical sensor mounted on the housing having an emitter and a receiver, the emitter and the receiver forming an optical path therebetween, the optical sensor having an output that changes when the optical path changes from blocked to unblocked and from unblocked to blocked;

a flag mounted on the housing having a first arm and a second arm, the flag having a home position where the first arm is disposed in the rotational path of the cam and the second arm is disposed in one of: blocking the optical path and unblocking the optical path; and a blocking member transversely mounted on the second arm for blocking at least a portion of the light emitted by the emitter;

wherein rotation of one of the shaft of the paddle and the shaft of the metering bar causes the cam to engage and disengage the first arm causing the second arm to change from one of blocking the optical path and unblocking the optical path.

12. The imaging apparatus of claim 11, further comprising a photoconductive drum disposed in the cartridge, the blocking member being aligned between the optical path and the photoconductive drum for blocking at least a portion of the light emitted by the emitter from the photoconductive drum.

13. The imaging apparatus of claim 11, further comprising a spring for biasing the flag toward the home position.

14. The imaging apparatus of claim 13, further comprising the flag having a pivot point between the first arm and the second arm, the engagement of the cam with the flag causing the flag to pivot about the pivot point away from the home position.

15. The imaging apparatus of claim 14, wherein the flag is a bell crank.

16. The imaging apparatus of claim 11, further comprising the optical sensor having a pair of opposed arms, the emitter and the receiver each mounted in a respective one of the pair of opposed arms and forming the optical path between the pair of opposed arms.

17. The imaging apparatus of claim 16, further comprising each of the pair of opposed arms of the optical sensor having a distal portion adjacent to the toner cartridge, wherein the blocking member contacts the distal portion of each of the pair of opposed arms when the flag is in the home position.

18. The imaging apparatus of claim 11, wherein the emitter emits light continuously when the imaging apparatus is turned on.

19. The imaging apparatus of claim 11, wherein the force imparted by the flag on the cam and one of the shaft of the paddle and the shaft of the metering bar is intermittent.

20. An imaging apparatus comprising:

a housing;

a toner cartridge having a toner reservoir therein, the toner reservoir having an upper sump area for containing toner and a lower sump area for containing toner;

a photoconductive drum disposed in the cartridge;

a metering bar rotatably positioned between the upper sump area and the lower sump area, the metering bar having a shaft and at least one depression for holding toner, wherein rotation of the metering bar transfers toner from the upper sump area to the lower sump area;

a paddle for moving toner toward the metering bar rotatably disposed in the upper sump area, the paddle having a shaft;

a cam mounted outside the toner cartridge on one of the shaft of the paddle and the shaft of the metering bar;

an optical sensor mounted on the housing having an emitter, a receiver and a pair of opposed arms for housing the emitter and receiver, each of the pair of opposed arms having a distal portion adjacent to the toner cartridge, the emitter and the receiver forming an optical path between the pair of opposed arms, the optical sensor having an output that changes when the optical path changes from blocked to unblocked and from unblocked to blocked;

a flag mounted on the housing and having the form of a pivotable bell crank having a first arm and a second arm, the flag having a home position where the first arm is disposed in the rotational path of the cam and the second arm blocks the optical path; and a blocking member transversely mounted on the second arm for blocking at least a portion of the light emitted by the emitter from contacting the photoconductive drum, the blocking member contacting the distal portion of each of the pair of opposed arms of the optical sensor when the flag is in the home position;

wherein rotation of one of the shaft of the paddle and the shaft of the metering bar causes the cam to engage and disengage the first arm causing the second arm to unblock and reblock, respectively, the optical sensor and the force imparted by the flag on the cam and one of the shaft of the paddle and the shaft of the metering bar is intermittent.

* * * * *